United States Patent [19]

Jesinsky, Jr.

[11] Patent Number: 4,530,173

[45] Date of Patent: Jul. 23, 1985

[54] EXCESSIVE PRONATION CORRECTING DEVICE

[76] Inventor: Edward G. Jesinsky, Jr., 3432 S. Locust St., Apt. F, Denver, Colo. 80222

[21] Appl. No.: 510,767

[22] Filed: Jul. 5, 1983

[51] Int. Cl.[3] ..... A43B 21/32; A43B 7/16

[52] U.S. Cl. ..... 36/92; 128/614; 36/37; 36/81

[58] Field of Search ..... 36/44, 92, 95, 37, 71, 36/69, 81; 128/581, 583, 584, 585, 596, 614

[56] References Cited

U.S. PATENT DOCUMENTS

| | | | |
|---|---|---|---|
| 1,945,780 | 2/1934 | Johnson . | |
| 2,379,366 | 6/1945 | Lumbard . | |
| 2,724,914 | 11/1955 | Wick . | |
| 2,814,133 | 11/1957 | Herbst | 36/37 |
| 3,124,887 | 3/1964 | Vassar | 36/81 |
| 3,416,245 | 12/1968 | Ferreira | 36/44 |
| 3,984,926 | 10/1976 | Calderon | 36/37 |
| 4,168,585 | 9/1979 | Gleichner | 36/71 |
| 4,180,924 | 1/1980 | Subotnick | 36/129 |
| 4,187,620 | 2/1980 | Selner . | |
| 4,346,525 | 8/1982 | Larsen et al. . | |

FOREIGN PATENT DOCUMENTS

| | | | |
|---|---|---|---|
| 406939 | 2/1910 | France | 128/614 |
| 7725 | of 1894 | United Kingdom | 36/37 |

*Primary Examiner*—Werner H. Schroeder
*Assistant Examiner*—Steven N. Meyers
*Attorney, Agent, or Firm*—Parkhurst & Oliff

[57] ABSTRACT

The present invention relates to a pronation correcting device designed to provide three important functions to correct excessive pronation and eliminate the adverse affects thereof. The wedge comprises a substantially flat cushion portion, a wedge cushion portion and a horseshoe shaped cushion portion. The device provides heel lift, outward heel rotation and stabilization of the heel.

6 Claims, 6 Drawing Figures

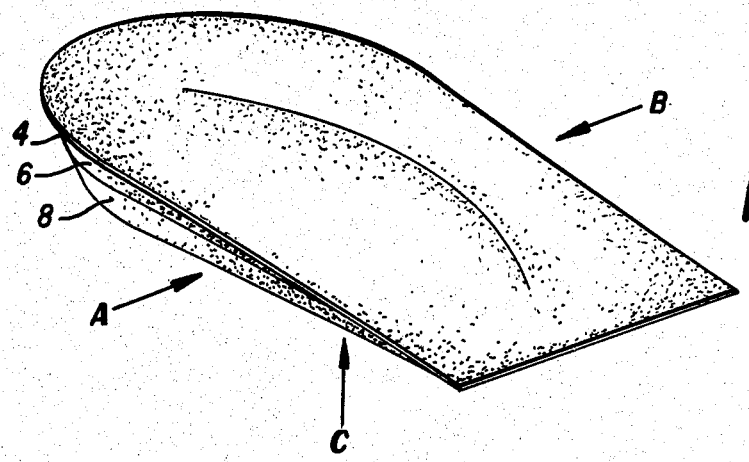
FIG. 1
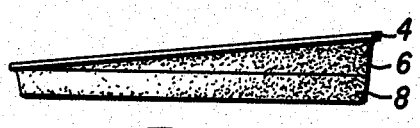
FIG. 2
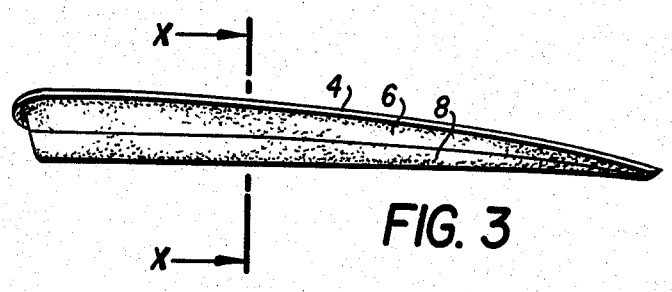
FIG. 3
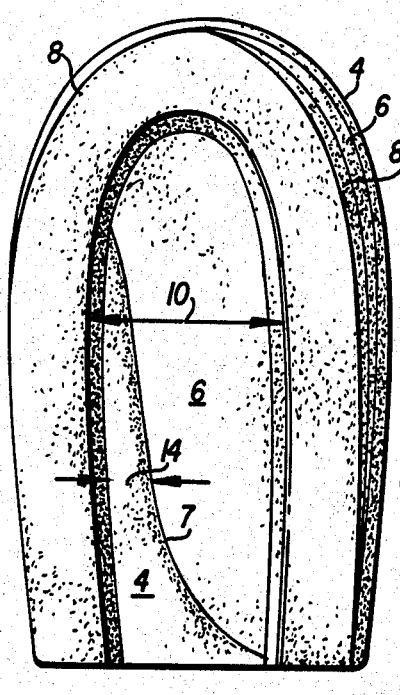
FIG. 5
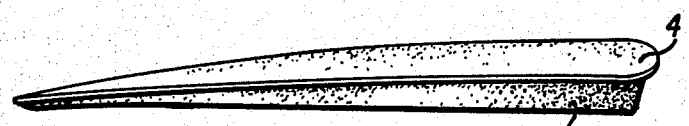
FIG. 4
FIG. 6
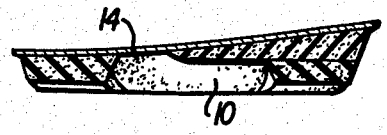

EXCESSIVE PRONATION CORRECTING DEVICE

BACKGROUND OF THE INVENTION

This invention relates to a structurally non-complex inexpensive pronation correcting device which eliminates the discomfort and performance problems associated with excessive pronation of the foot. This invention is primarily designed for use in ski boots but may be used in any type of footwear to correct excessive pronation.

Foot discomfort is the leading cause of attrition among skiers. To eliminate foot discomfort, the skier must choose the proper boot and adapt it to the individual characteristics of the foot. Almost every footwear fitting problem relates to a pronated foot. Pronation is a normal motion of the foot in the progression of a gate. Pronation is a three plane motion involving eversion (turning the bottom surface of the foot away from the body's midline), abduction (rotating the foot away from the body's median plane) and dorsal flexion (upward movement of top surface of the foot). Pronation is the normal movement of a foot and when within its ideal limits of movement, pronation causes no problems. However, about 85% of the population displays excessive pronation movements. This results in serious problems especially among athletes. Excessive pronation among skiers results in navicular pain, metatarsal pain, heel lift, arch cramps, bruised toes, sore knees and poor ski control.

Traditionally, various inserts have been used to remedy some of the problems associated with excessive pronation. Specifically, heel lifts, horseshoe cushions and varus wedges have been used.

The present invention incorporates all the advantages of a heel lift cushion, horseshoe wedge and varus wedge into one non-complex inexpensive device.

SUMMARY OF THE INVENTION

The present invention relates to an insert which is inserted into footwear directly under the heel of the foot between the arch and rear of the footwear which eliminates excessive pronation thereby eliminating the discomfort and performance problems associated with excessive pronation.

The present invention relates to a device exhibiting all the beneficial results not previously available in a single insert.

DESCRIPTION OF THE DRAWINGS

FIG. 1 is an elevated oblique view of the pronation correction device according to the present invention;

FIG. 2 is a rear view of the pronation correction device according to the present invention;

FIG. 3 is a side view of the pronation correcting device according to the present invention taken along the direction of arrow A of FIG. 1;

FIG. 4 is a side view of the pronation correcting device according to the present invention taken along the direction of arrow B of FIG. 1;

FIG. 5 is a bottom view of the pronation correction device according to the present invention taken along the direction of arrow C of FIG. 1; and FIG. 6 is a cross-sectional view taken along the line X—X of FIG. 3.

DESCRIPTION OF PREFERRED EMBODIMENTS

Referring to FIG. 1 of the drawings, a pronation correcting device according to the present invention for a left foot is shown. It is understood that a device configured as the mirror image of this represented device may be constructed for the right foot. The device is inserted into footwear directly below the heel of the foot between the arch and the rear of the footwear. The device 2 comprises three layers 4, 6 and 8. The layers may be comprised of any flexible material. Specifically, elastomeric materials such as polyurethanes may be used. Layer 4, the uppermost layer, is a flexible, substantially flat cushion member which lifts the heel to provide a degree of plantar flexion to the excessively pronated foot to minimize heel lift and the problems associated therewith. The middle layer 6 is a wedge shaped cushion member onto which the top layer 4 is secured. This wedge shaped member is positioned so that when inserted into footwear, the thickest portion is positioned substantially to the medial edge of the top layer 4. The thinnest portion extends laterally below the top layer 4 to a point short of the lateral most extension of the top layer 4. It is understood that the wedge shaped member 6 could extend laterally to any point below the top cushion member 4 including to the lateral-most point of extension of member 4. The device is constructed and placed in the footwear so the wedge member 6 slopes downwardly in a medial to lateral direction and in a direction from the rear of the footwear to the front of the footwear. This wedge member 6 rotates the heel of the excessively pronated foot (provides a degree of inversion) to bring it to the subtallar neutral position (when the material axis of the heel is parallel to the body's midline).

The bottom layer 8 is a horseshoe shaped cushion member whose periphery substantially follows the periphery of the top cover cushion member 4. The horseshoe shaped cushion member is attached to the lower side of the wedge shaped member 6 and the top cover 4 at points where the wedge member 6 does not extend over cover 4. The horseshoe shaped cushion member with its open central portion permits the top cover cushion 4 and wedge cushion 6 to relax downwardly when a person's weight is placed on the pronation correcting device. This sinking into the open central portion of the horseshoe member stabilizes the heel to prevent movement of the heel within the footwear. Heel lift is also minimized because the horseshoe member, like the top cover member 4, provides a degree of plantar flexion. This is particularly useful in ski boots to eliminate shin bite, toe bang, calf pinch, arch fatigue, heel spurs and matatarsal problems.

Referring to FIG. 2 of the drawings, a rear view of the pronation correction device is provided. In this view, the effect of the wedge cushion member 6 can be clearly seen. The wedge cushion member 6 gives a medial to lateral sloping orientation to top cushion 4 on which the heel rests. As discussed, it is this sloping effect which rotates the heel outwardly to relieve the painful effects of excessive pronation.

Referring to FIG. 3 of the drawings, a side view of the pronation correcting wedge taken along arrow A of FIG. 1 is provided. This is the side which corresponds to the medial side of the footwear when the pronation correcting device is inserted into the footwear. This of course is the thickest portion of the wedge and is responsible for rotation of the excessively pronated foot toward the neutral position.

Referring to FIG. 4 of the drawings, a side view taken along the direction of arrow B of FIG. 1 is provided. This side view shows the lateral side of the pronation correcting device according to the present invention. The wedge member 6 (of the particular embodiment represented in the drawings) does not extend to the lateral side of the device and is thus not seen in this view. The thickness at the outside of the wedge consists only of the top cushion member 4 and the horseshoe cushion member 8. Because the lateral portion of the pronation correction device is thinner in comparison with the thick medial portion, the heel is rotated towards the neutral position.

Referring to FIG. 5 of the drawings, a bottom view of the pronation correcting device according to the present invention is provided. In this view, the cooperation of the three layers of the pronation device can be best seen. The lateral of wedge cushion member 6 is seen at boundary 7. This view also clearly shows the open area 10 of the horseshoe shaped cushion member 8. It is into this area that the pressure on top member 4 permits top member 4 and wedge member 6 to sink and to provide the stabilizing effect of the pronation wedge according to the present invention.

Referring to FIG. 6 of the drawings, a cross-sectional view of the pronation correction device according to the present invention taken along line X—X of FIG. 3 is provided. This cross section clearly shows the features of the present invention which result in its three important functions. Specifically, this view shows the thickness of the pronation correcting device which provides a degree of plantar flexion which eliminates the problems associated with heel lift. The view also represents the sloping configuration of the device according to the present invention. The slope, from its high point at the medial side to its lowest point at the lateral side, rotates the excessively pronated foot towards the neutral position. The view also clearly shows the open areas 14 and 10 which provide a receptacle for the foot to sink into to stabilize the foot. The abbreviated lateral extension of wedge member 4 and the central open portion of horseshoe member 8 result in open areas 14 and 10 respectively as seen in FIG. 6 to permit sinking of top cushion member 4 thereinto upon the exertion pressure on top member 4 which results in the greatly improved stabilizing effect of the present invention.

The pronation correcting device according to the present invention may be constructed of individual layers fashioned into the respective shapes and secured together by any conventional technique such as adhesives. Additionally, while the foregoing discussion relates to a device having a layered construction, it is considered to be within the purview of this invention that the device could have a single piece construction achieved by molding. For example, the device could be made by injection molding elastomeric materials such as polyurethane. The molded device would be designed to have an exterior configuration identical to the external configuration of the layered device represented in the drawings. Further, the pronation correcting device can easily be made in a variety of sizes to accomodate different size footwear.

While the foregoing discussion focussed on ski boots as the primary use of the pronation correcting device, the pronation correcting device could be easily used in any type of footwear to achieve beneficial results. Further, it is apparent that alterations may be made without departing from the spirit and scope of the present invention.

What is claimed is:

1. A pronation correcting device for lifting, rotating and stabilizing the heel, comprising:

a substantially flat cushion member;

a wedge shaped cushion member secured to and below said substantially flat cushion member which, when said device is positioned in footwear, slopes downwardly in a direction from the rear of the footwear to the front of the footwear and in a direction from the medial side of the footwear to the lateral side of the footwear; and a horseshoe-shaped cushion member secured to and below said wedge shaped cushion member, the bight of said horseshoe-shaped cushion member being positioned adjacent to the rear of the footwear and the legs of said horseshoe-shaped member extending in a direction from the rear of the footwear towards the front of the footwear, an open area defined by said bight and legs of said horseshoe-shaped cushion member receiving a lower portion of said wedge shaped cushion member in response to an application of weight on said pronation correcting device thereby stabilizing the heel while correcting excessive pronation.

2. A pronation correcting device in accordance with claim 1, wherein the perimeter of said horseshoe-shaped member substantially coincides with the periphery of said substantially flat cushion member.

3. A pronation correcting device in accordance with claim 1, wherein the thickest portion of said wedge shaped member coincides with the medial edge of said substantially flat cushion member and the thinnest portion of said wedge member extends to a point between the medial edge and the lateral edge of said substantially flat cushion member.

4. A pronation correcting device for lifting, rotating and stabilizing the heel, comprising:

a substantially smooth foot contacting portion which, when said device is positioned in footwear, slopes downwardly in a direction from the rear of the footwear to the front of the footwear and in a direction from the medial side of the footwear to the lateral side of the footwear; and a footwear contacting portion having a substantially U-shaped surface of contact, the bight of said U-shaped surface being positioned adjacent to the rear of said footwear and the legs of said U-shaped surface extending in a direction from the rear of said footwear toward the front of said footwear, an open area defined by said bight and legs of said footwear contacting portion permitting deformation of said foot contacting portion into said open area in response to an application of weight on said pronation correcting device thereby stabilizing the heel while correcting excessive pronation.

5. A pronation correcting device for lifting, rotating and stabilizing the heel, comprising:

a one piece molded member configured to have a substantially smooth upper surface which, when said device is positioned in footwear, slopes downwardly in a direction from the rear of the footwear towards the front of the footwear and in a direction from the medial side of the footwear to the lateral side of the footwear, a U-shaped lower surface, the bight of which, when said device is positioned in footwear, is adjacent to the rear of the footwear and the legs of said U-shaped surface extend in a direction from the rear of the footwear towards the front of the footwear, an open area defined by said bight and legs of said U-shaped surface permitting deformation of said member into said open area in response to an application of weight on said pronation correcting device thereby stabilizing the heel while correcting excessive pronation.

6. A pronation correcting device for lifting, rotating and stabilizing the heel, comprising:

a smooth wedge shaped cushion member which, when said device is positioned in footwear, slopes downwardly in a direction from the rear of the footwear to the front of the footwear and in a direction from the medial side of the footwear to the lateral side of the footwear; and a horseshoe-shaped cushion member secured to and below said wedge shaped cushion member, the bight of said horseshoe shaped cushion member being positioned adjacent to the rear of the footwear and the legs of said horseshoe-shaped cushion extending in a direction from rear of said footwear towards the front of said footwear, an open area defined by said bight and legs of said horseshoe-shaped cushion member receiving a lower portion of said wedge shaped cushion member in response to an application of weight on said pronation correcting device thereby stabilizing the heel while correcting excessive pronation.

* * * * *